US010815847B2

(12) United States Patent
Barret et al.

(10) Patent No.: US 10,815,847 B2
(45) Date of Patent: Oct. 27, 2020

(54) EXHAUST GAS MUFFLER AND METHOD FOR THE MANUFACTURE THEREOF

(71) Applicant: Eberspächer Exhaust Technology GmbH & Co. KG, Neunkirchen (DE)

(72) Inventors: Ian Barret, Stuttgart (DE); Laurent Cazeneuve, Saint Rémy l'Honoré (FR)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 373 days.

(21) Appl. No.: 15/825,830

(22) Filed: Nov. 29, 2017

(65) Prior Publication Data

US 2018/0149053 A1 May 31, 2018

(30) Foreign Application Priority Data

Nov. 30, 2016 (DE) ..... 10 2016 123 139

(51) Int. Cl.
*F01N 1/08* (2006.01)
*F01N 13/18* (2010.01)

(52) U.S. Cl.
CPC ..... *F01N 1/083* (2013.01); *F01N 1/08* (2013.01); *F01N 13/1805* (2013.01); *F01N 13/1838* (2013.01); *F01N 13/1872* (2013.01); *F01N 2450/00* (2013.01); *F01N 2450/22* (2013.01); *F01N 2470/04* (2013.01); *F01N 2470/06* (2013.01); *F01N 2470/08* (2013.01); *F01N 2470/18* (2013.01)

(58) Field of Classification Search
CPC ..... F01N 1/08; F01N 1/083; F01N 13/1805; F01N 13/1838; F01N 13/1872; F01N 2450/00; F01N 2450/22; F01N 2470/04; F01N 2470/06; F01N 2470/08; F01N 2470/18
USPC ..... 181/228
See application file for complete search history.

(56) References Cited

U.S. PATENT DOCUMENTS 6,832,665 B2 * 12/2004 Crombeen ..... F01N 1/089 181/212
7,104,359 B1 * 9/2006 Zelinski ..... F01N 1/083 181/238
8,083,822 B2 * 12/2011 Hoffman ..... F01N 3/2892 123/184.57

(Continued)

FOREIGN PATENT DOCUMENTS

CN 2825969 Y 10/2006
CN 102996203 A 3/2013

(Continued)

*Primary Examiner* — Forrest M Phillips
(74) *Attorney, Agent, or Firm* — McGlew and Tuttle, P.C.

(57) ABSTRACT

An exhaust gas muffler, for an exhaust system of an internal combustion engine, includes a muffler housing (12) with a circumferential wall (14) elongated in a housing axis (L) direction and with an end wall (20, 22) at each axial end area (16, 18). Two exhaust gas pipe holding openings (44, 46) are provided in the circumferential wall (14) with an exhaust gas pipe (40) fixed to the circumferential wall (14) in an area of each exhaust gas pipe holding opening (44, 46) and open towards a housing interior (24). The exhaust gas pipe (40) is preferably closed at one end area (54) by a closing element (58). The exhaust gas pipe (40) has at least one exhaust gas passage opening (66) in a length area (64) extending between the two exhaust gas pipe holding openings (44, 46).

20 Claims, 2 Drawing Sheets

(56) References Cited

U.S. PATENT DOCUMENTS

| | | | | |
|---|---|---|---|---|
| 8,092,563 | B2 * | 1/2012 | Crandell | F01N 3/28 123/184.57 |
| 8,097,055 | B2 * | 1/2012 | Staley | F01N 13/08 123/184.57 |
| 8,661,795 | B2 * | 3/2014 | Eavenson, Sr. | F01N 3/2885 181/213 |
| 8,820,475 | B2 * | 9/2014 | Pradhan | F01N 1/04 181/266 |
| 9,976,460 | B2 * | 5/2018 | Khan | F01N 3/0335 |
| 10,196,947 | B2 * | 2/2019 | LeRoy | F01N 1/083 |
| 10,393,001 | B2 * | 8/2019 | Thorn | F01N 13/107 |
| 10,450,912 | B2 * | 10/2019 | Donnelly | F01N 1/08 |
| 2006/0231330 | A1 * | 10/2006 | Morales | F01N 1/02 181/272 |
| 2007/0151798 | A1 * | 7/2007 | Smith | F01N 1/04 181/256 |
| 2009/0101434 | A1 * | 4/2009 | Sammut | F01N 1/006 181/227 |
| 2012/0311984 | A1 * | 12/2012 | Mitsuda | F01N 13/1805 55/508 |
| 2013/0153329 | A1 * | 6/2013 | Bischel | F01N 13/08 181/228 |
| 2013/0213734 | A1 * | 8/2013 | Ahn | F01N 13/08 181/256 |
| 2014/0231167 | A1 * | 8/2014 | Hiramatsu | F01N 13/141 181/212 |
| 2017/0218806 | A1 * | 8/2017 | LeRoy | F01N 1/083 |
| 2017/0276043 | A1 * | 9/2017 | Khan | F01N 3/0335 |
| 2019/0178124 | A1 * | 6/2019 | Ostromecki | F01N 1/003 |
| 2019/0383198 | A1 * | 12/2019 | Yang | F01N 3/005 |

FOREIGN PATENT DOCUMENTS

| | | | | |
|---|---|---|---|---|
| CN | 204024770 | U | 12/2014 | |
| CN | 205638610 | U | 10/2016 | |
| DE | 10 2011 077 183 | A1 | 12/2012 | |
| EP | 1 888 891 | B2 | 11/2013 | |
| EP | 2 682 575 | A1 | 1/2014 | |
| JP | 2000-303 822 | A | 10/2000 | |
| JP | 2005-330 839 | A | 12/2005 | |
| KR | 200 438 615 | Y1 | 2/2008 | |
| WO | WO-0032910 | A1 * | 6/2000 | F01N 1/085 |

* cited by examiner

EXHAUST GAS MUFFLER AND METHOD FOR THE MANUFACTURE THEREOF

CROSS REFERENCE TO RELATED APPLICATIONS

This application claims the benefit of priority under 35 U.S.C. § 119 of German Application 10 2016 123 139.8, filed Nov. 30, 2016, the entire contents of which are incorporated herein by reference.

FIELD OF THE INVENTION

The present invention pertains to an exhaust gas muffler for an exhaust system of an internal combustion engine, which is used, for example, as a drive unit in a vehicle.

BACKGROUND OF THE INVENTION

An exhaust gas muffler according to the preamble of claim 1 is known from EP 1 888 891 B2. In this exhaust gas muffler, an exhaust gas pipe holding opening each is provided in a circumferential wall of a muffler housing in association with two inlet pipes, in the area of which exhaust gas pipe holding opening a corresponding inlet pipe is fixed to the circumferential wall of the muffler housing. A carrier plate traversed by the inlet pipe and supporting same is provided between two intermediate walls each in a housing interior of the muffler housing in association with each inlet pipe. The inlet pipe, which is, for example, multipart, is curved approximately at right angles in a length area between this carrier plate and an intermediate wall supporting a downstream end area of the inlet pipe.

SUMMARY OF THE INVENTION

An object of the present invention is to provide an exhaust gas muffler and a method for the manufacture thereof, with which a reliable holding of the exhaust gas pipe with respect to a muffler housing can be achieved with a simplified configuration.

According to a first aspect of the present invention, this object is accomplished by an exhaust gas muffler for an exhaust system of an internal combustion engine, comprising: —a muffler housing with a circumferential wall elongated in the direction of a housing axis and with an end wall at each axial end area of the circumferential wall, and —at least one exhaust gas pipe held in the area of an exhaust gas pipe holding opening at the circumferential wall and open towards a housing interior.

The exhaust gas muffler according to the present invention is characterized in that two exhaust gas pipe holding openings are provided in the circumferential wall in association with at least one exhaust gas pipe, that the exhaust gas pipe is fixed to the circumferential wall in the area of each exhaust gas pipe holding opening, that the exhaust gas pipe is preferably closed at one end area by means of a closing element, and that the at least one exhaust gas pipe has at least one exhaust gas passage opening in a length area extending between the two exhaust gas pipe holding openings.

Since at least one exhaust gas pipe is fixed to the circumferential wall in the area of corresponding exhaust gas pipe holding openings associated with this exhaust gas pipe in case of the exhaust gas muffler according to the present invention, no additional components to be provided in the housing interior of a muffler housing are necessary in order to guarantee a stable holding of the exhaust gas pipe. The connection to the circumferential wall in the area of two exhaust gas pipe holding openings associated with the exhaust gas pipe leads to a very stable configuration of the exhaust gas muffler, in which only such components, which are necessary for the muffling characteristic to be achieved, are to be provided in the housing interior.

In order to be able to guarantee a stable and gas-tight connection when an exhaust gas pipe is fixed to the circumferential wall, it is proposed that a holding edge area, which protrudes from the circumferential wall and encloses the exhaust gas pipe holding opening preferably without interruption, be provided in the area of at least one, preferably of each of the exhaust gas pipe holding openings associated with the at least one exhaust gas pipe.

In this connection, a configuration, which is simple to produce and avoids a mutual disturbance with components provided in the housing interior, can be achieved by at least one, preferably by each holding edge area being configured as protruding outwards away from the housing interior, or/and by at least one, preferably each holding edge area being provided as a passage.

A stable and gas-tight closure can further be guaranteed by the at least one exhaust gas pipe being fixed by connection in substance, preferably by welding, to the circumferential wall in the area of at least one, preferably of each of the exhaust gas pipe holding openings associated with this exhaust gas pipe, or/and by the closing element being inserted into the end area of the at least one exhaust gas pipe and being fixed thereto by connection in substance, preferably by welding.

In order to facilitate the insertion of an exhaust gas pipe into the exhaust gas pipe holding openings in the circumferential wall associated with this exhaust gas pipe, provisions may be made for one of the exhaust gas pipe holding openings associated with the at least one exhaust gas pipe to have a smaller cross-sectional dimension, preferably a smaller inside diameter, than the other exhaust gas pipe holding opening associated with this exhaust gas pipe, and by the exhaust gas pipe having a cross-section reduction between its areas fixed to the circumferential wall in the area of the exhaust gas pipe holding openings.

The exhaust gas muffler according to the present invention is preferably configured such that the end area of the at least one exhaust gas pipe is positioned in the area of one of the exhaust gas pipe holding openings associated with this exhaust gas pipe, and by another end area of the at least one exhaust gas pipe being located in the area of the other exhaust gas pipe holding opening associated with this exhaust gas pipe or outside the housing interior.

In order to keep the flow resistance as low as possible for exhaust gas to be fed into the muffler housing, provisions are further made for a plurality of exhaust gas passage openings to be provided at the at least one exhaust gas pipe, wherein at least some of the, preferably all exhaust gas passage openings are elongated in the direction of an exhaust gas pipe longitudinal axis of this exhaust gas pipe or/and at least one ring formation of exhaust gas passage openings following one another in the circumferential direction is provided about the exhaust gas pipe longitudinal axis.

To achieve the muffling characteristic to be provided by the exhaust gas muffler, provisions may be made for at least one intermediate wall to be provided in the housing interior, wherein the exhaust gas pipe holding openings associated with the at least one exhaust gas pipe are arranged in the direction of the housing axis between two intermediate walls or between an intermediate wall and an end wall.

For a structurally simple configuration, it is proposed that the at least one exhaust gas pipe not be supported between its areas fixed to the circumferential wall in the area of the exhaust gas pipe holding openings associated with this exhaust gas pipe with respect to the muffler housing or/and be connected to the muffler housing. Such an additional support is not necessary in case of the exhaust gas muffler according to the present invention because the exhaust gas pipe is supported at two areas in a stable manner with respect to the circumferential wall of the muffler housing.

It is proposed in an especially preferred configuration of the exhaust gas muffler according to the present invention that at least one exhaust gas pipe be an inlet pipe, and that at least one outlet pipe leading out of the housing interior be provided. In this case, at least one outlet pipe is carried at an end wall.

According to another aspect of the present invention, the object indicated in the introduction is accomplished by a method for the manufacture of an exhaust gas muffler according to the present invention, comprising the steps:

a) Provision of the muffler housing with two exhaust gas pipe holding openings in association with at least one exhaust gas pipe to be fixed to the muffler housing in the circumferential wall, b) insertion of the at least one exhaust gas pipe into the exhaust gas pipe holding openings provided in the circumferential wall in association with this exhaust gas pipe, c) fixing of the at least one exhaust gas pipe to the circumferential wall in the area of the exhaust gas pipe holding openings associated with this exhaust gas pipe, and d) arrangement of the closing element preferably at the end area of the at least one exhaust gas pipe before step b) or/and step c) or after step c).

For the construction of the muffler according to the present invention from sheet metal material, provisions may be made for the circumferential wall of the muffler housing to be provided as an essentially sheet-shaped blank in step a) and for the exhaust gas pipe holding openings associated with the at least one exhaust gas pipe to be provided at the blank, preferably as passages, before the shaping of the sheet-shaped blank into an essentially cylindrical configuration.

The at least one exhaust gas pipe may be fixed by connection in substance, preferably by welding, to the circumferential wall in the area of the exhaust gas pipe holding openings associated with this exhaust gas pipe in step c).

To keep the number of working steps to be carried out during the manufacture of the exhaust gas muffler according to the present invention as low as possible, it is proposed that at the same time, the at least one exhaust gas pipe be fixed by connection in substance, preferably by welding, to the circumferential wall and that the closing element be fixed by connection in substance, preferably by welding, to the exhaust gas pipe or/and to the circumferential wall in step c).

The present invention further pertains to an exhaust system for an internal combustion engine, preferably in a vehicle, comprising at least one exhaust gas muffler according to the present invention, which is preferably manufactured with a method according to the present invention.

The present invention will now be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
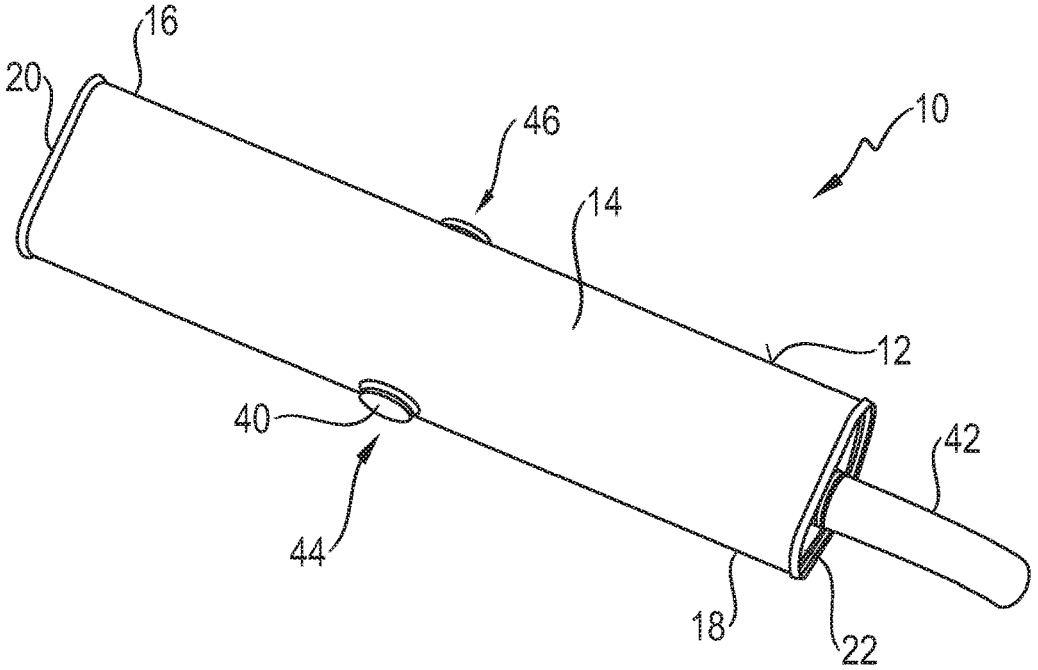
FIG. 1 is an exhaust gas muffler in a perspective view.
Figure 2:
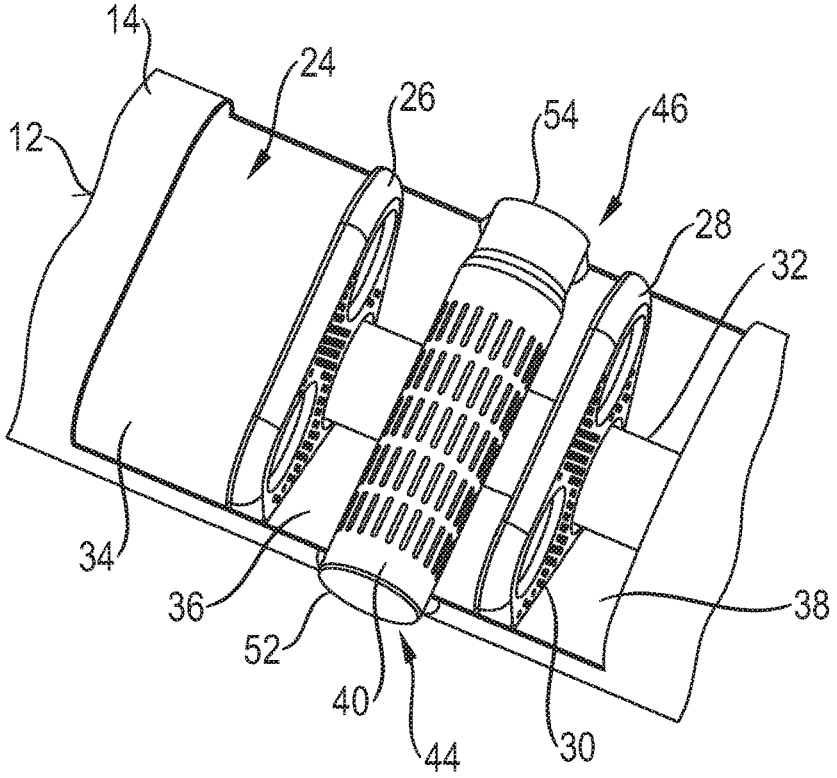
FIG. 2 is the central area of the exhaust gas muffler of FIG. 1 with partially cut-open muffler housing.
Figure 3:
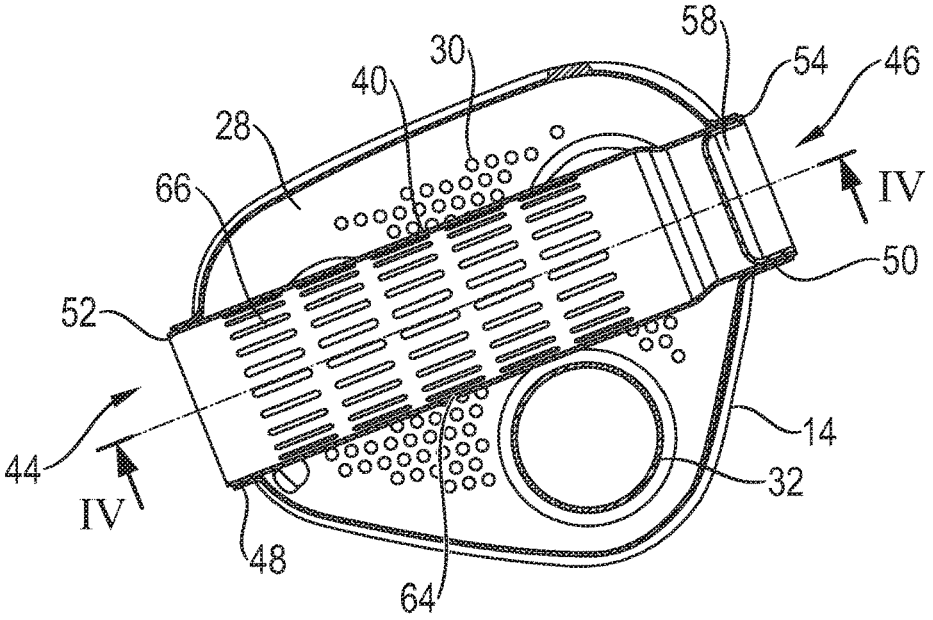
FIG. 3 is a cross-sectional view of the exhaust gas muffler of FIG. 1, cut along a line III-III in FIG. 4.

Referring to the drawings, an exhaust gas muffler to be arranged in an exhaust system of an internal combustion engine of a vehicle is generally designated by 10 in FIGS. 1-4. The exhaust gas muffler 10 comprises a muffler housing 12 with an essentially cylindrical circumferential wall 14 elongated in the direction of a housing axis L and with an end wall 20, 22 each at both axial end areas 16, 18 of the circumferential wall 14. A plurality of intermediate walls 26, 28 following one another in the direction of the housing axis L are provided in a housing interior 24 of the muffler housing 12, which intermediate walls 26, 28 divide the housing interior 24 into a plurality of chambers 34, 36, 38, which are in connection with one another, for example, through openings 30 in the intermediate walls 26, 28 or/and by one or more connecting pipes 32.

Exhaust gas discharged from an internal combustion engine is fed into the housing interior 24 via an inlet pipe 40 described in detail below and providing an exhaust gas pipe. The exhaust gas is discharged from the muffler housing 12, for example, to the surrounding area or to a section of the exhaust system following downstream via an outlet pipe 42, which traverses the end wall 22 and is made integral, for example, with the connecting pipe 32 or is connected to same.

Two exhaust gas pipe holding openings 44, 46 are provided in the circumferential wall 14 of the muffler housing 12 in association with the inlet pipe 40. An essentially cylindrical holding edge area 48, 50, which preferably fully encloses the respective exhaust gas pipe holding opening 44, 46 and which is provided, for example, as a passage, is provided in the area of each of the exhaust gas pipe holding openings 44, 46. The inlet pipe 40 is inserted into the exhaust gas pipe holding openings 44, 46 in the circumferential wall 14 associated with this inlet pipe, so that it is positioned with its upstream area 52 in the area of the holding edge area 48 of the exhaust gas pipe holding opening 44 and is positioned with its downstream end area 54 in the area of the holding edge area 50 of the exhaust gas pipe holding opening 46.

Figure 4:
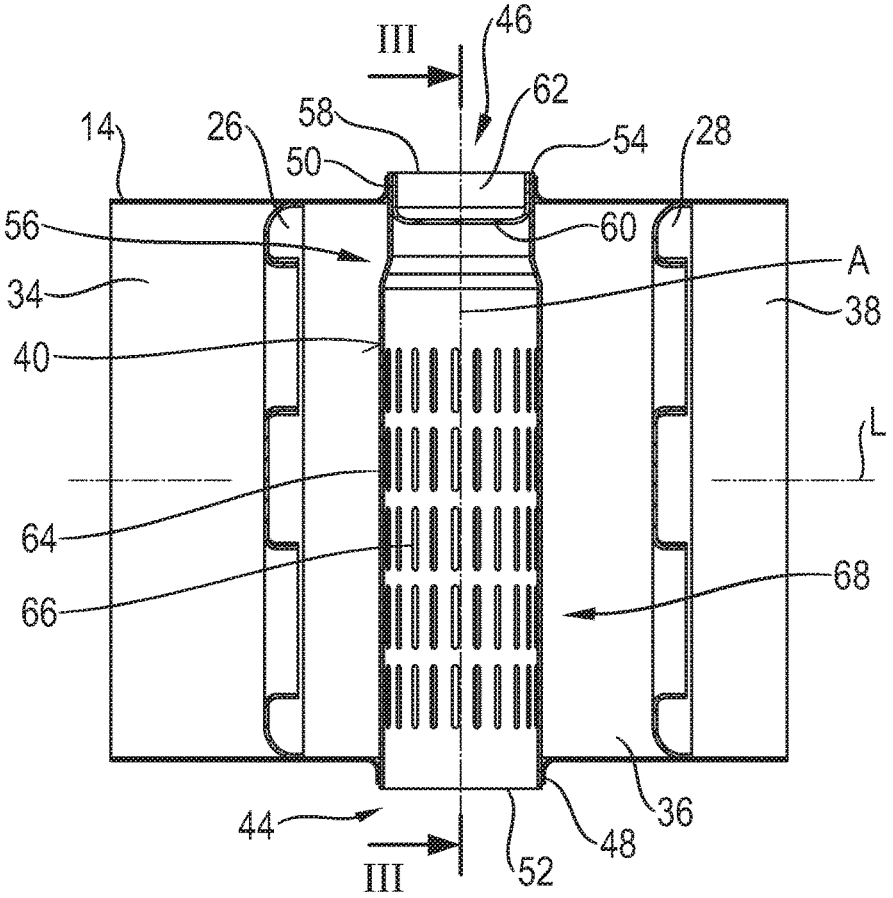
FIG. 4 is a longitudinal sectional view of the exhaust gas muffler of FIG. 1, cut along a line IV-IV in FIG. 3.

FIG. 4 shows that the inlet pipe 40 has a cross-sectional reduction 56, which is, for example, step-like, between its end areas 52, 54 positioned in the area of the circumferential wall 14 and the exhaust gas pipe holding openings 44, 46, respectively, wherein the inlet pipe 40 has, in principle, a circular cross-sectional geometry. In adaptation to this cross-sectional reduction 56, the exhaust gas pipe holding opening 46 receiving the downstream end area 54 of the inlet pipe 40 is configured with a smaller inside dimension, for example, a smaller inside diameter, than the exhaust gas pipe holding opening 44 receiving the upstream end area 52. In this connection, the exhaust gas pipe holding openings 44, 46 are coordinated in terms of their dimensioning with the dimensioning of the inlet pipe 40 in its two end areas 52, 54 such that a fit of the inlet pipe 40 into the exhaust gas pipe holding opening 44, 46, which fit is as accurate as possible and is essentially free from play, is achieved after the insertion of the inlet pipe 40 into the exhaust gas pipe holding openings 44, 46.

A cap-like or pot-like closing element 58 with a bottom area 60 and with a preferably essentially cylindrical circumferential area 62, which is fitted essentially free from play into the downstream end area 54 of the inlet pipe 40, is inserted into the inlet pipe 40 at the downstream area 54 of the inlet pipe 40. FIG. 4 illustrates that the holding edge area 50 of the exhaust gas pipe holding opening 46, the downstream end area 54 of the inlet pipe 40 and the circumferential area 62 of the closing element are positioned overlapping one another in the direction of an inlet pipe longitudinal axis A. This makes it possible to connect these three components to one another in a single working step, for example, by means of circular welding, so that, on the one hand, a stable holding of the inlet pipe 40 at the circumferential wall and a stable holding of the closing element 58 at the inlet pipe 40 is guaranteed, and a gas-tight closure of the housing interior 24 is achieved, on the other hand.

The inlet pipe 40 is preferably fixed by welding to the circumferential wall 14 with the holding edge area 48 in the upstream end area 52 as well in order to achieve a connection of the inlet pipe 40 to the circumferential wall 14 of the muffler housing 12, which connection is stable and guarantees a gas-tight closure of the housing interior 24, in this end area 52 as well.

The inlet pipe 40 has a plurality of exhaust gas passage openings 66 in its length area 64, which is between its two end areas 52, 54, i.e., in the housing interior 24. The exhaust gas passage openings 66, which are preferably elongated in the direction of the exhaust gas pipe longitudinal axis A and also extend in this direction, are arranged, to provide a large overall opening cross-sectional area, in a plurality of ring formations 68 following one another in the direction of the exhaust gas pipe longitudinal axis A each with a plurality of exhaust gas passage openings 66 following one another in the circumferential direction about the exhaust gas pipe longitudinal axis A.

In the case of the manufacture of the exhaust gas muffler 10 shown in FIGS. 1-4, it is possible to proceed such that first the circumferential wall 14 is provided as a sheet-shaped sheet metal blank. In this sheet-shaped sheet metal blank, the exhaust gas pipe holding openings 44, 46 associated with the inlet pipe 40 can then be provided, for example, as passages or as openings created by means of perforation. The circumferential wall 14 is then wound around the components to be mounted in it into an essentially cylindrical, tubular configuration for constructing the muffler housing, so that the circumferential wall encloses the intermediate walls 26, 28 to be provided therein and the two exhaust gas pipe holding openings 44, 46 are positioned essentially opposite one another. During this process or subsequently, for example, the two end walls 20, 22, as well as the connecting pipe 32 and also the outlet pipe 42 may then also be installed.

The inlet pipe 40 with its downstream end area 54 is then inserted into the exhaust gas pipe holding openings 44, 46 located opposite one another first through the exhaust gas pipe holding opening 44 and then into the exhaust gas pipe holding opening 46. Already before insertion of the inlet pipe 40 into the exhaust gas pipe holding openings 44, 46 or when the inlet pipe 40 is already inserted into the exhaust gas pipe holding openings 44, 46, the closing element 58 is fitted into the downstream area 54 of the inlet pipe 40. The inlet pipe 40 is then connected by connection in substance, preferably by welding, in the two end areas 52, 54 to the circumferential wall 14, especially to the holding edge areas 48, 50 preferably provided integral thereto, wherein at the same time the closing element 58 is also fixed to the inlet pipe 40 and to the circumferential wall 14 at the downstream end area 54.

With its length area 64 having the exhaust gas passage openings 66, the inlet pipe 40 is then located in the chamber 36 formed between the two intermediate walls 26, 28, so that exhaust gas flowing via the inlet pipe 40 can flow via the exhaust gas passage openings 66 into the chamber 36 and from the chamber 36 into the chambers 34, 38.

It should be noted that the exhaust gas muffler 10 shown in FIGS. 1-4 can be modified in a wide variety of ways, without deviating from the principles of the present invention. Thus, for example, a plurality of inlet pipes may be provided, of which preferably, but not necessarily, a plurality, preferably all, can be fixed to the circumferential wall in the manner described above. A plurality of outlet pipes may also be provided. As an alternative or in addition, one or more outlet pipes may lead out of the muffler housing in the area of the circumferential wall and may be fixed to the circumferential wall as exhaust gas pipes in the manner described above.

Further, the structure in the housing interior may be configured differently than shown in FIGS. 1-4. More or fewer intermediate walls than the intermediate walls shown may be provided, and at least one exhaust gas pipe may be fixed to the circumferential wall between an intermediate wall and an end wall. The inlet pipe or optionally the inlet pipes could further be configured such that it is not positioned with its upstream end area in the area of the circumferential wall of the muffler housing, but rather it extends from the muffler housing and provides a front pipe leading to the exhaust gas muffler with this length area extending outside the muffler housing.

The closing element may also be configured or dimensioned such that it is not inserted into the end area of the inlet pipe, but rather can be positioned with a circumferential area enclosing the holding edge area at the circumferential wall and the exhaust gas pipe holding opening provided in the circumferential wall can be fixed to the circumferential wall overlapping from outside. When the closing element is inserted into the inlet pipe, the closing element may be arranged, for example, offset with respect to the downstream end area with its bottom area in the upstream direction, so that it closes the inlet pipe at a slight distance from the downstream end area thereof.

While specific embodiments of the invention have been shown and described in detail to illustrate the application of the principles of the invention, it will be understood that the invention may be embodied otherwise without departing from such principles.

What is claimed is:

1. An exhaust gas muffler for an exhaust system of an internal combustion engine, the exhaust gas muffler comprising:

a muffler housing with a circumferential wall elongated in a direction of a housing axis with two exhaust gas pipe holding openings provided in the circumferential wall and with an end wall at each axial end area of the circumferential wall;

at least one exhaust gas pipe fixed to the circumferential wall in the area of each of the two exhaust gas pipe holding openings; and a closing element closing the at least one exhaust gas pipe at one end area of the at least one exhaust gas pipe, wherein the at least one exhaust gas pipe has at least one exhaust gas passage opening in a length area extending between the two exhaust gas pipe holding openings, the at least one exhaust gas pipe being fixed by a weld connection to the circumferential wall in the area of each one of the two exhaust gas pipe holding openings associated with the at least one exhaust gas pipe and the closing element being inserted into the end area of the at least one exhaust gas pipe and the closing element being fixed thereto by a weld connection, wherein one of the exhaust gas pipe holding openings associated with the at least one exhaust gas pipe has a smaller inside diameter than another one of the exhaust gas pipe holding openings associated with the at least one exhaust gas pipe and the at least one exhaust gas pipe has a cross-section reduction between areas fixed to the circumferential wall in the area of the exhaust gas pipe holding openings.

2. An exhaust gas muffler in accordance with claim 1, wherein:

at least one of the exhaust gas pipe holding openings associated with the at least one exhaust gas pipe has a holding edge area protruding from the circumferential wall and enclosing said at least one exhaust gas pipe holding opening; and the closing element closes the at least one exhaust pipe at one end area of the at least one exhaust pipe.

3. An exhaust gas muffler in accordance with claim 2, wherein the holding edge area is configured as protruding outwards away from the housing interior, or the holding edge area is provided as a passage or the holding edge area is configured as protruding outwards away from the housing interior and the holding edge area is provided as a passage.

4. An exhaust gas muffler in accordance with claim 1, wherein the circumferential wall comprises a first circumferential wall portion and a second circumferential wall portion, the first circumferential wall portion defining the one of the two exhaust gas pipe holding openings, the second circumferential wall portion defining the another one of the two exhaust gas pipe holding openings, the circumferential wall defining at least a portion of an exhaust chamber, the at least one exhaust gas pipe comprising at least a pipe portion extending continuously from at least the first circumferential wall portion through the exhaust chamber to at least the second circumferential wall portion, wherein the at least one gas pipe defines a fluid flow path for delivering exhaust fluid to the exhaust chamber.

5. An exhaust gas muffler in accordance with claim 1, wherein the end area of the at least one exhaust gas pipe is positioned in an area of one of the exhaust gas pipe holding openings associated with this exhaust gas pipe and another end area of the at least one exhaust gas pipe is located in the area of the other exhaust gas pipe holding opening associated with this exhaust gas pipe or outside the housing interior.

6. An exhaust gas muffler in accordance with claim 1, wherein:

the at least one exhaust gas passage opening in a length area comprises a plurality of exhaust gas passage openings; and at least some of the exhaust gas passage openings are elongated in a direction of an exhaust gas pipe longitudinal axis of this exhaust gas pipe or at least one ring formation of exhaust gas passage openings following one another in the circumferential direction is provided about the exhaust gas pipe longitudinal axis or at least some of the exhaust gas passage openings are elongated in a direction of an exhaust gas pipe longitudinal axis of this exhaust gas pipe and at least one ring formation of exhaust gas passage openings following one another in the circumferential direction is provided about the exhaust gas pipe longitudinal axis.

7. An exhaust gas muffler in accordance with claim 1, further comprising at least one intermediate wall provided in the housing interior, wherein the exhaust gas pipe holding openings associated with the at least one exhaust gas pipe are arranged in the direction of the housing axis between two intermediate walls or between an intermediate wall and one of the end walls.

8. An exhaust gas muffler in accordance with claim 1, wherein the at least one exhaust gas pipe is not supported between the areas fixed to the circumferential wall in the area of the exhaust gas pipe holding openings associated with this exhaust gas pipe in terms of the muffler housing or is connected to the muffler housing or the at least one exhaust gas pipe is not supported between the areas fixed to the circumferential wall in the area of the exhaust gas pipe holding openings associated with this exhaust gas pipe in terms of the muffler housing and is connected to the muffler housing.

9. An exhaust gas muffler in accordance with claim 1, further comprising at least one outlet pipe leading out of the housing interior wherein the at least one exhaust gas pipe is an inlet pipe.

10. An exhaust gas muffler in accordance with claim 9, wherein at least one outlet pipe is carried at one of the end walls.

11. A method for the manufacture of an exhaust gas muffler comprising a muffler housing with a circumferential wall elongated in a direction of a housing axis with two exhaust gas pipe holding openings provided in the circumferential wall and with an end wall at each axial end area of the circumferential wall, at least one exhaust gas pipe fixed to the circumferential wall in the area of each of the two exhaust gas pipe holding openings and a closing element closing the at least one exhaust gas pipe at one end area of the at least one exhaust gas pipe, wherein the at least one exhaust gas pipe has at least one exhaust gas passage opening in a length area extending between the two exhaust gas pipe holding openings, the method comprising the steps of:

providing the muffler housing with the two exhaust gas pipe holding openings in association with the at least one exhaust gas pipe to be fixed to the muffler housing in the circumferential wall, one of the exhaust gas pipe holding openings associated with the at least one exhaust gas pipe having a smaller inside diameter than another one of the exhaust gas pipe holding openings associated with the at least one exhaust gas pipe;

providing the at least one exhaust gas pipe such that the at least one exhaust pipe has a cross-section reduction between areas to be fixed to the circumferential wall in the area of the exhaust gas pipe holding openings;

inserting the at least one exhaust gas pipe into the exhaust gas pipe holding openings provided in the circumferential wall in association with this exhaust gas pipe;

fixing the at least one exhaust gas pipe to the circumferential wall in the area of the exhaust gas pipe holding openings associated with this exhaust gas pipe by providing a weld connection to the circumferential wall in the area of each one of the exhaust gas pipe holding openings associated with the at least one exhaust gas pipe; and arranging the closing element at the end area of the at least one exhaust gas pipe by inserting the closing element into the end area of the at least one exhaust gas pipe and fixing the closing element thereto by a weld connection.

12. A method in accordance with claim 11, wherein the circumferential wall of the muffler housing is provided as an essentially sheet-shaped blank in said step of providing the muffler housing and the exhaust gas pipe holding openings associated with the at least one exhaust gas pipe are provided at the blank, as passages, before a shaping of the sheet-shaped blank into an essentially cylindrical configuration.

13. A method in accordance with claim 11, wherein the at least one exhaust gas pipe is fixed by forming a weld connection to the circumferential wall in the area of the exhaust gas pipe holding openings associated with this exhaust gas pipe in said step of fixing the at least one exhaust gas pipe to the circumferential wall.

14. A method in accordance with claim 11, wherein the at least one exhaust gas pipe is fixed by forming the weld connection in an end area of the at least one exhaust gas pipe to the circumferential wall and the closing element is simultaneously fixed by forming the weld connection to the exhaust gas pipe or to the circumferential wall or to both the exhaust gas pipe and the circumferential wall.

15. An exhaust system for an internal combustion engine, the exhaust system comprising at least one exhaust gas muffler, the at least one exhaust gas muffler comprising:

a muffler housing with a circumferential wall elongated in a direction of a housing axis with two exhaust gas pipe holding openings provided in the circumferential wall and with an end wall at each axial end area of the circumferential wall;

at least one exhaust gas pipe fixed to the circumferential wall in the area of each of the two exhaust gas pipe holding openings; and a closing element closing the at least one exhaust gas pipe at one end area of the at least one exhaust gas pipe, wherein the at least one exhaust gas pipe has at least one exhaust gas passage opening in a length area extending between the two exhaust gas pipe holding openings, the at least one exhaust gas pipe being fixed by a weld connection to the circumferential wall in the area of each one of the exhaust gas pipe holding openings associated with the at least one exhaust gas pipe and the closing element being inserted into the end area of the at least one exhaust gas pipe and the closing element being fixed thereto by a weld connection, wherein one of the exhaust gas pipe holding openings associated with the at least one exhaust gas pipe has a smaller inside diameter than another one of the exhaust gas pipe holding openings associated with the at least one exhaust gas pipe and the at least one exhaust gas pipe has a cross-section reduction between areas fixed to the circumferential wall in the area of the exhaust gas pipe holding openings.

16. An exhaust system in accordance with claim 15, wherein at least one of the exhaust gas pipe holding openings associated with the at least one exhaust gas pipe has a holding edge area protruding from the circumferential wall and enclosing said at least one exhaust gas pipe holding opening.

17. An exhaust system in accordance with claim 16, wherein the at least one exhaust gas muffler is formed by a method comprising the steps of:

providing the muffler housing with the two exhaust gas pipe holding openings in association with the at least one exhaust gas pipe to be fixed to the muffler housing in the circumferential wall;

inserting the at least one exhaust gas pipe into the exhaust gas pipe holding openings provided in the circumferential wall in association with this exhaust gas pipe;

fixing the at least one exhaust gas pipe to the circumferential wall in the area of the exhaust gas pipe holding openings associated with this exhaust gas pipe; and arranging the closing element at the end area of the at least one exhaust gas pipe.

18. An exhaust system in accordance with claim 17, wherein the circumferential wall of the muffler housing is provided as an essentially sheet-shaped blank in said step of providing the muffler housing and the exhaust gas pipe holding openings associated with the at least one exhaust gas pipe are provided at the blank, as passages, before a shaping of the sheet-shaped blank into an essentially cylindrical configuration.

19. An exhaust system in accordance with claim 18, wherein the at least one exhaust gas pipe is fixed by forming the weld connection in an end area of the at least one exhaust gas pipe to the circumferential wall and the closing element is simultaneously fixed by forming the weld connection to the exhaust gas pipe or to the circumferential wall or to both the exhaust gas pipe and the circumferential wall.

20. An exhaust system in accordance with claim 15, wherein the circumferential wall comprises a first circumferential wall portion and a second circumferential wall portion, the first circumferential wall portion defining the one of the two exhaust gas pipe holding openings, the second circumferential wall portion defining the another one of the two exhaust gas pipe holding openings, the circumferential wall defining at least a portion of an exhaust chamber, the at least one exhaust gas pipe comprising at least a pipe portion extending continuously from at least the first circumferential wall portion through the exhaust chamber to at least the second circumferential wall portion, wherein the at least one gas pipe defines a fluid flow path for delivering exhaust fluid to the exhaust chamber.

* * * * *